US006446927B1

(12) United States Patent
Nuss

(10) Patent No.: US 6,446,927 B1
(45) Date of Patent: Sep. 10, 2002

(54) PAPER TOWEL DISPENSER

(76) Inventor: Oscar F. Nuss, 7918 Croyden Ave., Los Angeles, CA (US) 90045

( * ) Notice: Subject to any disclaimer, the term of this patent is extended or adjusted under 35 U.S.C. 154(b) by 0 days.

(21) Appl. No.: 09/791,141

(22) Filed: Feb. 22, 2001

Related U.S. Application Data

(60) Provisional application No. 60/183,886, filed on Feb. 22, 2000.

(51) Int. Cl.[7] ..... A47K 10/32
(52) U.S. Cl. ..... 248/309.2; 211/16
(58) Field of Search ..... 248/309.2, 905; 206/389; 242/570; 211/16

(56) References Cited

U.S. PATENT DOCUMENTS

| | | | | | |
|---|---|---|---|---|---|
| 3,088,686 | A | * | 5/1963 | Curry | 242/55.2 |
| 3,593,361 | A | * | 7/1971 | Welt | 15/230.11 |
| 4,097,002 | A | * | 6/1978 | Krueger | 242/55.2 |
| 4,105,168 | A | * | 8/1978 | Rutherford | 242/55.2 |
| 5,662,288 | A | * | 9/1997 | Chiang | 242/596.8 |

* cited by examiner

*Primary Examiner*—Anita King
*Assistant Examiner*—Ingrid Weinhold
(74) *Attorney, Agent, or Firm*—Joseph N. Breaux

(57) ABSTRACT

A paper towel dispenser that includes an adjustable bracket for supporting a roll of paper towels. The adjustable bracket includes a pair of support plates that are adjustable to support rolls of a user selected width.

1 Claim, 2 Drawing Sheets

PAPER TOWEL DISPENSER

This application claims the benefit of provisional application Ser. No. 60/183,886 filed Feb. 22, 2000.

TECHNICAL FIELD

The present invention relates to paper towel dispensers and more particularly to a paper towel dispenser that includes a towel holding bracket having a pair of spaced, parallel oriented, towel tube support plates connected together by a distance adjustment mechanism including a cavity portion, a slide bar, and a locking screw.

GENERAL SUMMARY DISCUSSION OF INVENTION

It is thus an object of the invention to provide a paper towel dispenser that includes a towel holding bracket having a pair of spaced, parallel oriented, towel tube support plates connected together by a distance adjustment mechanism including a cavity portion, a slide bar, and a locking screw.

Accordingly, a paper towel dispenser is provided. The paper towel dispenser includes a towel holding bracket having a pair of spaced, parallel oriented, towel tube support plates connected together by a distance adjustment mechanism including a cavity portion, a slide bar, and a locking screw; the cavity portion having a first cavity portion end attached to one of the towel tube support plates and a bar insertion opening provided through a second cavity portion end in connection with a bar receiving cavity provided within the cavity portion; the slide bar having a first bar end slidably positionable within the bar receiving cavity through the bar insertion opening and a second bar end connected to the other towel tube support plate; the locking screw being threaded through an internally threaded locking screw aperture formed through a wall of the cavity portion between an exterior surface of the cavity portion and the bar receiving cavity; the locking screw being turnable in a first direction to place a holding force against the slide bar in a manner to hold the slide bar in fixed relation to the cavity portion and, thereby, maintain the pair of spaced, parallel oriented, towel tube support plates at a user selected distance apart to correspond with the length of a particular roll of disposable towels.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
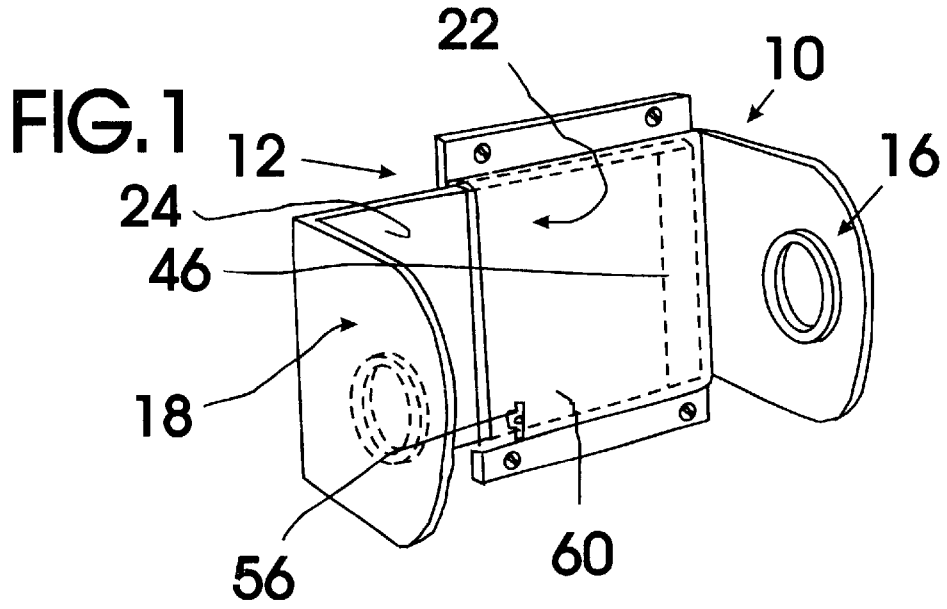
FIG. 1 is a perspective view of an exemplary embodiment of the paper towel dispenser of the present invention in the small roll holding configuration.
Figure 2:
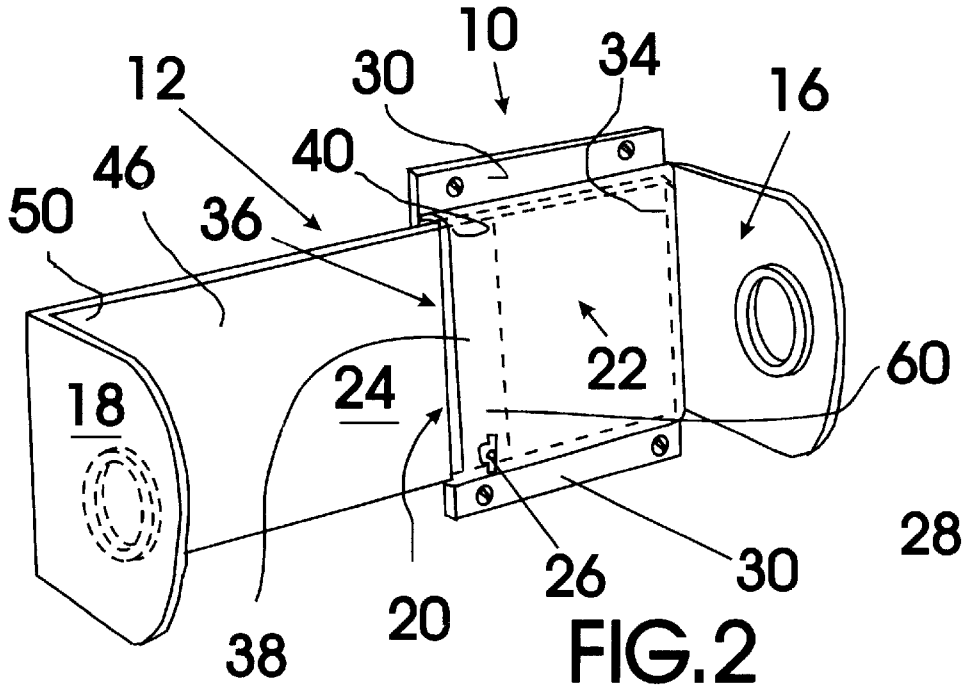
FIG. 2 is a perspective view of the exemplary embodiment of the paper towel dispenser of the present invention in the large roll holding configuration.

FIGS. 1–4 show various aspects of an exemplary embodiment of the paper towel dispenser of the present invention generally designated 10. Paper towel dispenser 10 is constructed of plastic and includes a towel holding bracket, generally designated 12, having two spaced, parallel oriented, towel tube support plates, generally designated 16,18, respectively, connected together by a distance adjustment mechanism, generally designated 20.

Figure 3:
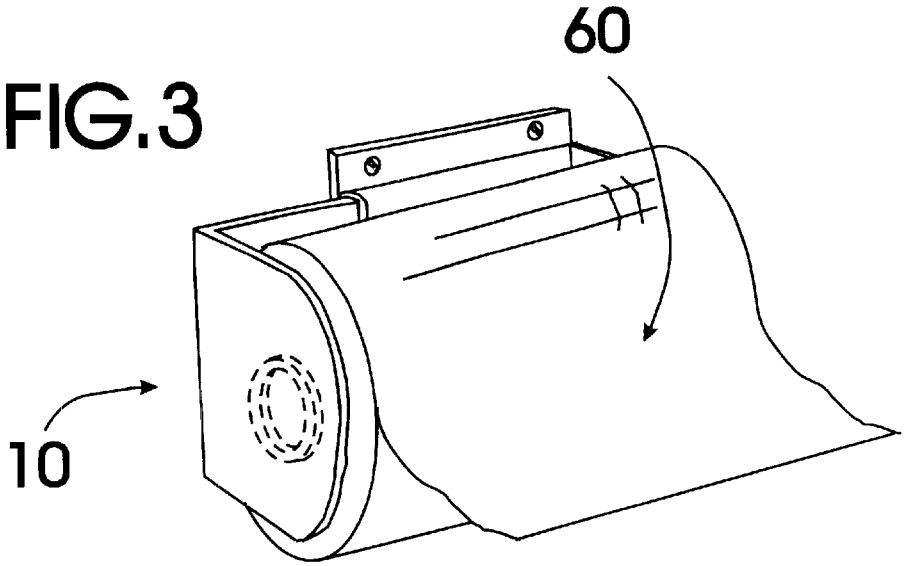
FIG. 3 is a perspective view of an exemplary embodiment of the paper towel dispenser of the present invention in the small roll holding configuration holding a representative small roll of aper towels.
Figure 4:
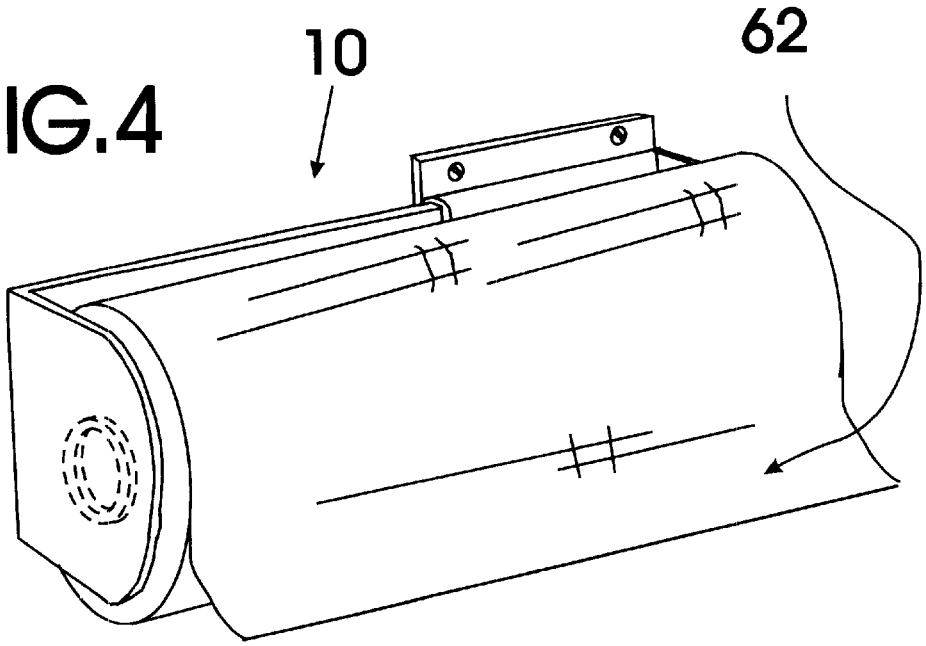
FIG. 4 is a perspective view of an exemplary embodiment of the paper towel dispenser of the present invention in the large roll holding configuration holding a representative large roll of aper towels.

Distance adjustment mechanism 20 includes a cavity portion, generally designated 22, a slide bar, generally designated 24; and a locking screw 26 having a wing-shaped knob portion 28. Cavity portion 22 has two mounting plates 30, a first cavity portion end 34 attached to towel tube support plate 16, and a bar insertion opening 36 provided through a second cavity portion end 38 and in connection with a bar receiving cavity 40 (shown in dashed lines). Slide bar 24 has a first bar end 46 slidably positioned within bar receiving cavity 40 through bar insertion opening 36 and a second bar end 50 connected to towel tube support plate 18. Locking screw 26 is threaded through an internally threaded locking screw aperture 56 formed through a wall 60 of cavity portion 22 between an exterior surface of the cavity portion 22 and bar receiving cavity 40. In use, locking screw 26 is turned in a first direction to place holding force against the slide bar 24 in a manner to hold the slide bar 24 in fixed relation to the cavity portion 22 and, thereby, maintain the pair of spaced, parallel oriented, towel tube support plates 16,18 at a user selected distance apart to correspond with the length of a particular roll of disposable towels 61,62 as shown in FIGS. 3 and 4. Roll 61 is one-half of he width of roll 62.

It can be seen from the preceding description that a paper towel dispenser has been provided.

It is noted that the embodiment of the paper towel dispenser described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A paper towel dispenser consisting:

a towel holding bracket having a pair of spaced, parallel oriented, towel tube support plates connected together by a distance adjustment mechanism including a cavity portion having two for mounting the paper towel dispenser to a wall a slide bar, and a locking screw;

the cavity portion having a first cavity portion end attached to one of the towel tube support plates and a bar insertion opening provided through a second cavity portion end in connection with a bar receiving cavity provided within the cavity portion;

the slide bar having a first bar end slidably positionable within the bar receiving cavity through the bar insertion opening and a second bar end connected to the other towel tube support plate;

the locking screw being threaded through an internally threaded locking screw aperture formed through a wall of the cavity portion between an exterior surface of the cavity portion and the bar receiving cavity;

the locking screw being turnable in a first direction to place a holding force against the slide bar in a manner to hold the slide bar in fixed relation to the cavity portion and, thereby, maintain the pair of spaced, parallel oriented, towel tube support plates at a user selected distance apart to correspond with the length of a particular roll of disposable towels.

* * * * *